US011320220B1

(12) United States Patent
Stephenson et al.

(10) Patent No.: US 11,320,220 B1
(45) Date of Patent: May 3, 2022

(54) FIREARM

(71) Applicants: Allen Daniel Stephenson, Greer, SC (US); James Clowney Brice, IV, Greer, SC (US); Rob Randazzo, Greer, SC (US)

(72) Inventors: Allen Daniel Stephenson, Greer, SC (US); James Clowney Brice, IV, Greer, SC (US); Rob Randazzo, Greer, SC (US)

(73) Assignee: NRJ Holdings, LLC, Greer, SC (US)

( * ) Notice: Subject to any disclaimer, the term of this patent is extended or adjusted under 35 U.S.C. 154(b) by 0 days.

(21) Appl. No.: 17/592,308

(22) Filed: Feb. 3, 2022

(51) Int. Cl.
*F41A 3/66* (2006.01)
*F41A 3/26* (2006.01)
*F41A 11/02* (2006.01)

(52) U.S. Cl.
CPC ..... *F41A 3/66* (2013.01); *F41A 3/26* (2013.01); *F41A 11/02* (2013.01)

(58) Field of Classification Search
CPC ..... F41A 3/66
See application file for complete search history.

(56) References Cited

U.S. PATENT DOCUMENTS

| | | | | |
|---|---|---|---|---|
| 10,378,839 | B1 | 8/2019 | Bratic | |
| 10,436,530 | B2 | 10/2019 | Overstreet et al. | |
| 10,890,391 | B1 * | 1/2021 | Geissele | F41A 3/66 |
| 11,118,851 | B2 | 9/2021 | Peterson et al. | |
| 11,181,332 | B2 | 11/2021 | Kasanjian-King | |
| 2016/0033219 | A1 * | 2/2016 | Meier | F41A 5/26 42/17 |
| 2017/0299292 | A1 * | 10/2017 | Daley, Jr. | F41A 3/66 |
| 2020/0064090 | A1 * | 2/2020 | Russell | F41A 3/66 |
| 2020/0386495 | A1 | 12/2020 | Hamilton | |
| 2021/0063103 | A1 | 3/2021 | Becklin | |
| 2021/0102780 | A1 | 4/2021 | Senff et al. | |
| 2021/0140729 | A1 | 5/2021 | McMillan | |
| 2021/0270551 | A1 | 9/2021 | Underwood et al. | |
| 2021/0293498 | A1 | 9/2021 | Underwood et al. | |
| 2021/0372719 | A1 | 12/2021 | Stroda | |

* cited by examiner

*Primary Examiner* — J. Woodrow Eldred
(74) *Attorney, Agent, or Firm* — Steve LeBlanc, LLC

(57) ABSTRACT

A firearm includes a barrel having a breech end. An upper receiver is engaged with the breech end of the barrel such that a majority of the barrel is outside of the upper receiver. A lower receiver is releasably connected to the upper receiver, and the firearm includes structure for slidingly connecting the upper receiver to the lower receiver.

20 Claims, 7 Drawing Sheets

FIREARM

FIELD OF THE INVENTION

The present invention generally involves a firearm. Particular embodiments of the present invention may be incorporated into a semi-automatic or automatic pistol or rifle.

BACKGROUND OF THE INVENTION

FIG. 1 provides a perspective view of an AR-style firearm 10. The "AR" designation refers to ArmaLite, Inc., the company credited with originally designing this style of firearm in the 1950s. As shown in FIG. 1, the AR-style firearm 10 includes a receiver 12 that houses and/or integrates the other components of the firearm 10. For example, the receiver 12 provides a centrally located structure to house a bolt assembly 14 and a trigger assembly 16 while also integrating other components, such as a barrel 18, a grip 20, a scope 22, and a buttstock 24, into the operable firearm 10.

The length of the barrel 18 and presence of the buttstock 24 determine the classification of the AR-style firearm 10 as either a pistol or a rifle. A firearm having either a buttstock or at least a 26-inch barrel is currently classified as a rifle; whereas a firearm with no buttstock and a shorter barrel is currently classified as a pistol or a handgun. As used herein, the term "firearm" refers to either a pistol, a handgun, or a rifle.

For the AR-style firearm 10 shown in FIG. 1, the receiver 12 includes an upper receiver 26 and a lower receiver 28. A pivot pin 30 extends through the upper and lower receivers 26, 28 to pivotally connect the upper receiver 26 to the lower receiver 28. A takedown pin 32 extends through the upper and lower receivers 26, 28 to firmly lock the upper and lower receivers 26, 28 together for operation. In this manner, the pivot pin 30 and takedown pin 32 enhance the ability to readily disassemble and reassemble the upper and lower receivers 26, 28 to inspect, clean, and/or replace the components in the firearm 10.

Although the design of the AR-style firearm 10 shown in FIG. 1 has many benefits, the connection between the upper and lower receivers 26, 28 may be improved. For example, repetitive use, assembly, and disassembly of the firearm 10 may erode the surfaces of the pivot and takedown pins 30, 32. The eroded surfaces result in increased clearances between the connected components, resulting in movement or "slop" between the upper and lower receivers 26, 28. Excessive movement or "slop" between the upper and lower receivers 26, 28 may allow gases to prematurely escape the receiver or dirt to enter the receiver and generally impacts the reliable operation of the firearm 10. Although shims may be used to reduce any movement or the pins may be periodically replaced, the need exists for an improved design to connect the upper and lower receivers 26, 28.

BRIEF DESCRIPTION OF THE INVENTION

Aspects and advantages of the invention are set forth below in the following description, or may be obvious from the description, or may be learned through practice of the invention.

One embodiment of the present invention is a firearm that includes a barrel having a breech end. An upper receiver is engaged with the breech end of the barrel such that a majority of the barrel is outside of the upper receiver. A lower receiver is releasably connected to the upper receiver, and the firearm includes structure for slidingly connecting the upper receiver to the lower receiver.

An alternate embodiment of the present invention is a firearm that includes a barrel having a breech end and an upper receiver engaged with the breech end of the barrel such that a majority of the barrel is outside of the upper receiver. The firearm further includes a first side of the upper receiver and a second side of the upper receiver opposed to the first side of the upper receiver. A first groove extends axially along the first side of the upper receiver, and a second groove extends axially along the second side of the upper receiver. A lower receiver is slidingly connected to the first and second grooves of the upper receiver.

In yet another embodiment of the present invention, a firearm includes a barrel having a breech end and an upper receiver engaged with the breech end of the barrel such that a majority of the barrel is outside of the upper receiver. A lower receiver is releasably connected to the upper receiver and has a first side and a second side opposed to the first side. A first groove extends axially along the first side of the lower receiver, and a second groove extends axially along the second side of the lower receiver. The first and second grooves slidingly engage with the upper receiver.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
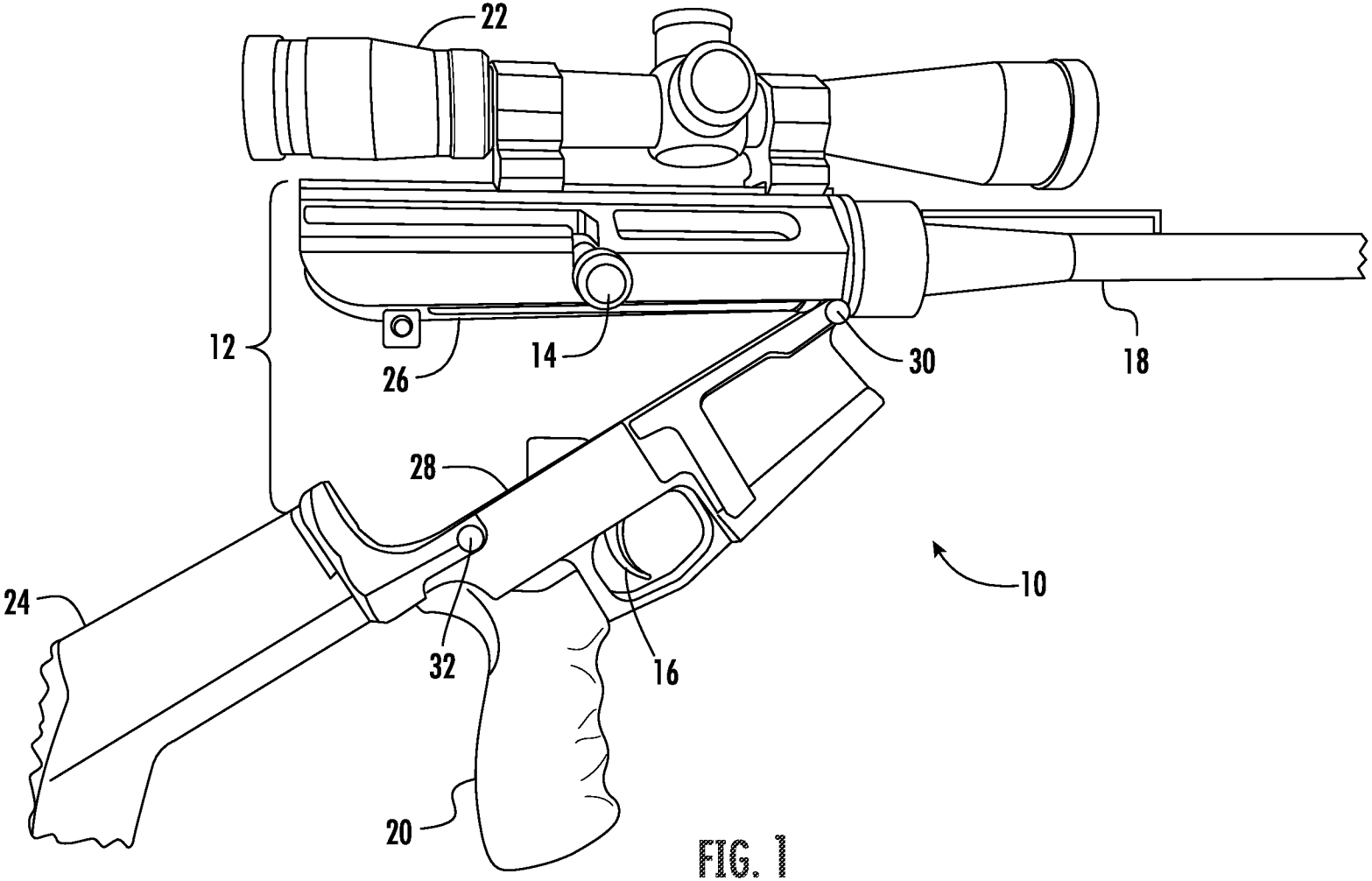
FIG. 1 is a side view of an AR-style firearm.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, the terms "upstream" and "downstream" refer to the location of items with reference to the direction of fluid flow in a fluid pathway. For example, item A is "upstream" from item B and item B is downstream from item A if fluid normally flows from item A to item B. As used herein, "axial" refers to the direction of the longer axis of a component, "radial" refers to the direction perpendicular to the axial direction, and "circumferential" refers to the direction around a component. As used herein, the term "firearm" refers to either a pistol, a handgun, or a rifle.

Figure 2:
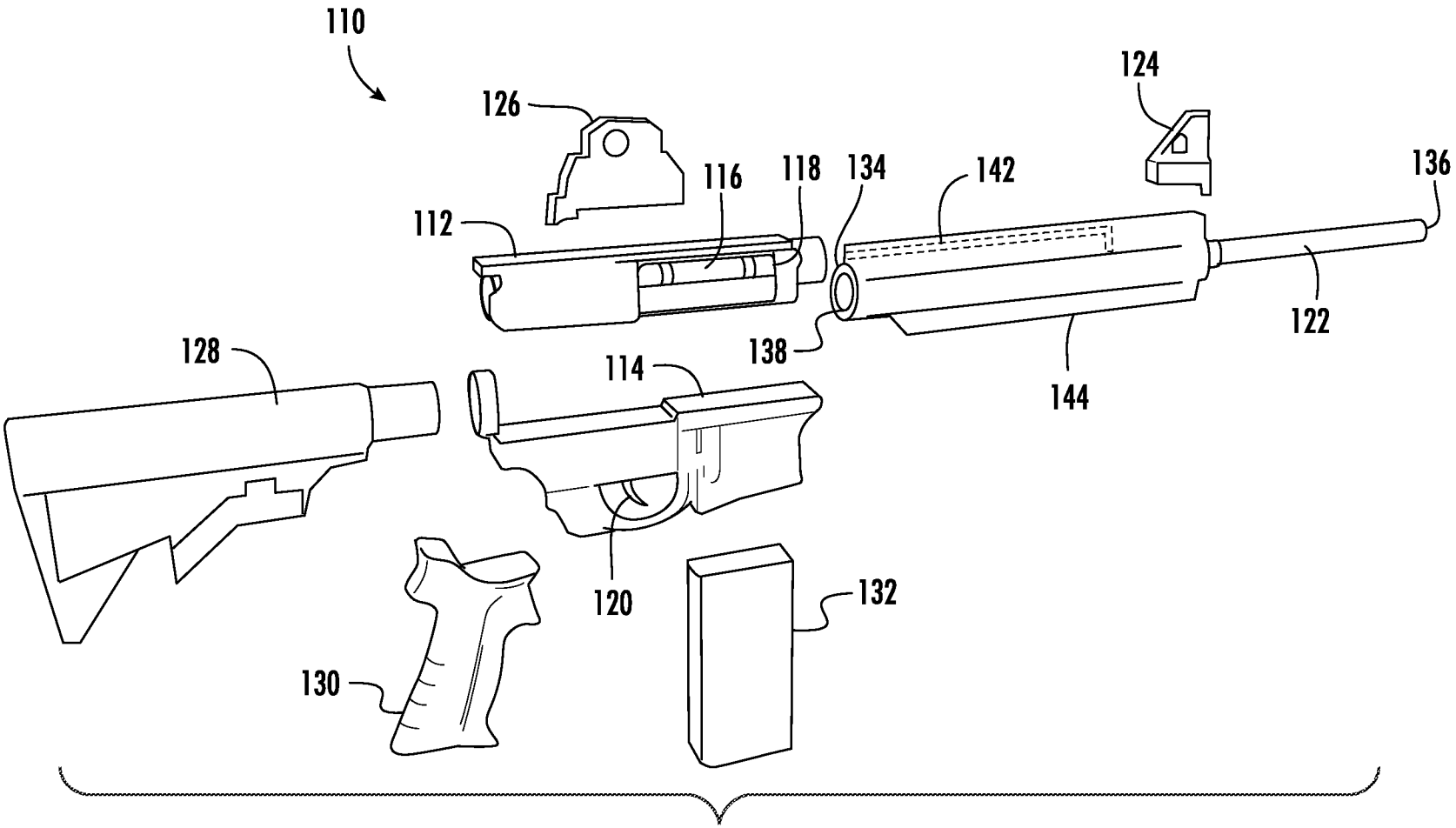
FIG. 2 is an exploded perspective view of a firearm according to one embodiment of the present invention.
Figure 3:
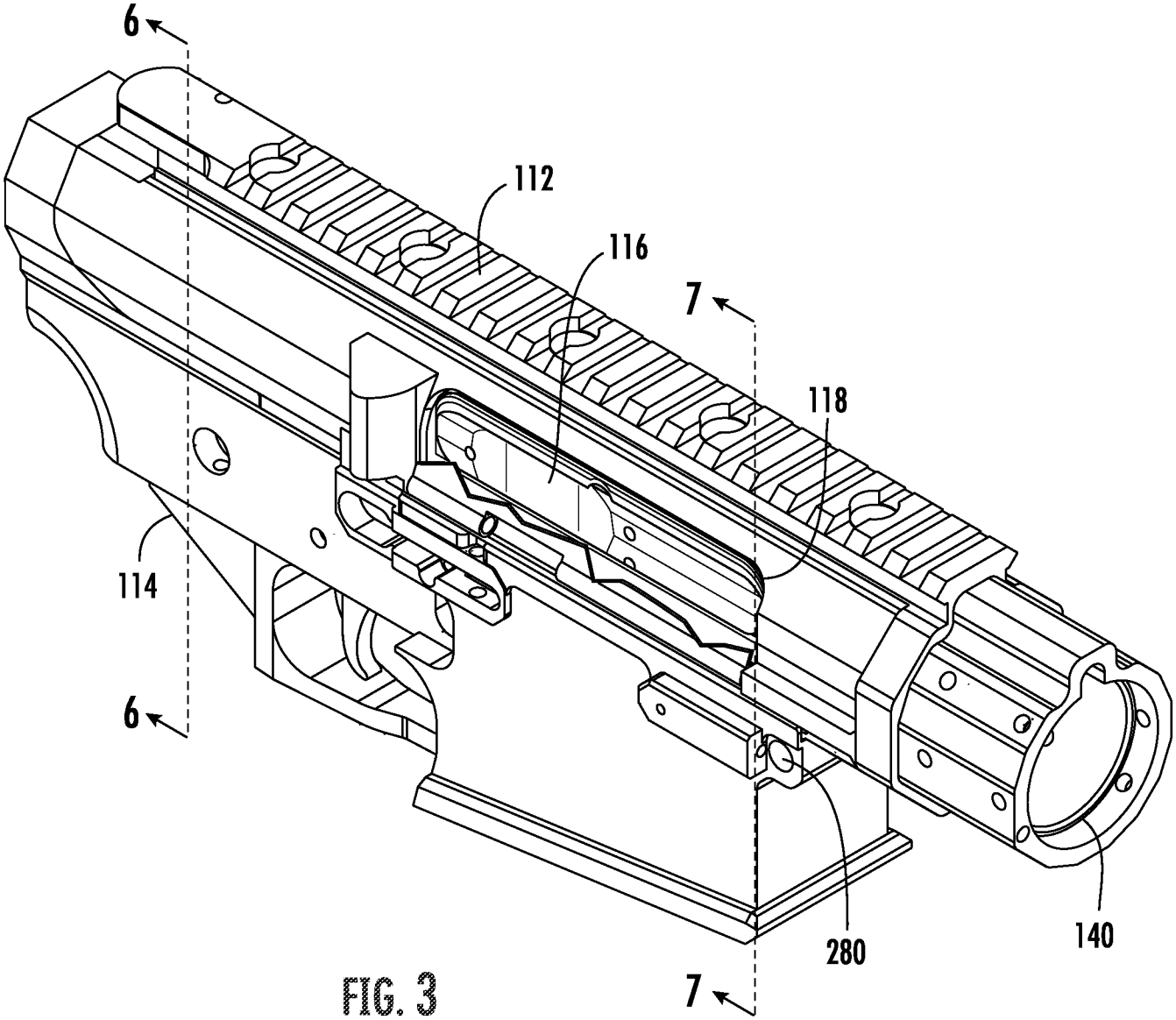
FIG. 3 is a right, front perspective view of the upper and lower receivers shown in FIG. 2.

FIG. 2 provides an exploded perspective view of a firearm 110 according to one embodiment of the present invention, and FIG. 3 provides a right, front perspective view of the upper and lower receivers 112, 114 shown in FIG. 2. As shown in FIG. 2, the firearm 110 includes an upper receiver 112 and a lower receiver 114 that house and/or integrate the other components of the firearm 110. For example, the upper receiver 112 may house a bolt assembly 116, visible through an ejection port 118, while the lower receiver 114 may house a trigger assembly 120. The other major components shown in FIG. 2 include a barrel 122, front and rear sights 124, 126, a buttstock 128, a grip 130, and a magazine 132. However, the present invention is not limited to any particular components housed or integrated into the firearm 110 unless recited in the claims.

The barrel 122 has a breach end 134 opposed to a muzzle end 136, and the upper receiver 112 releasably engages with the breach end 134 of the barrel 122 so that a majority of the barrel 122 is outside of the upper receiver 112. For example, the breach end 134 of the barrel 122 may include threads 138 that screw into complementary threads 140 in the upper receiver 112 (shown in FIG. 3) to facilitate assembly and disassembly of the barrel 122 from the upper receiver 112. As shown in FIG. 2, the barrel 122 may further include a gas tube 142 (shown in phantom in FIG. 2) that provides fluid communication from downstream of the breach end 134 of the barrel 122 to the upper receiver 112. In this manner, as combustion gases propel a bullet through the barrel 122, the gas tube 142 diverts a portion of the combustion gases back to the upper receiver 112 to cycle the bolt assembly 116.

A hand guard 144 may extend axially from the upper receiver 112 around the barrel 122 and the gas tube 142. The hand guard 144 may perform several functions. For example, the hand guard 144 may envelop the gas tube 142 to protect the gas tube 142 from damage and interference. In addition, the hand guard 144 may prevent direct contact with a portion of the barrel 122, which may become hot during operation, while providing a convenient surface for gripping the forward end of the firearm 110 and attaching the front sight 124. The rear sight 126 may attach to the upper receiver 112 to be used in conjunction with the front sight 124 to aim the firearm 110. Alternately, the front and rear sights 124, 126 may be replaced with a scope attached to the upper receiver 112, as shown in FIG. 1.

The lower receiver 114 may similarly facilitate releasable attachment of the buttstock 128, grip 130, and magazine 132 to the firearm 110 so each component may be easily replaced depending on the user's needs or preferences. For example, the buttstock 128 may be threaded or bolted to the lower receiver 114 to facilitate replacement with a buttstock 128 having a different length, material construction, weight, etc. Similarly, the lower receiver 114 may releasably connect to the grip 130 and magazine 132 so that each of these components may be easily replaced according to the user's needs or preferences.

The upper and lower receivers 112, 114 are typically forged, machined, or stamped from steel or aluminum, and final specifications may be achieved through a Computerized Numerical Control (CNC) lathe or other machinery. In particular embodiments, the upper and/or lower receivers 112, 114 may be fabricated from polymers or sintered metal powders to achieve the desired size, shape, strength, hardness, and fatigue characteristics. The various materials and methods for fabricating the upper and lower receivers 112, 114 enable each to be modularly constructed to accommodate multiple components and accessories according to the particular user's needs and specifications.

The firearm 110 includes means for slidingly connecting the upper receiver 112 to the lower receiver 114. The function of the means is to allow the upper receiver 112 to slidingly connect to the lower receiver 114. The structure for performing this function may include any combination of one or more complementary rails and/or grooves on the upper and lower receivers 112, 114. In particular embodiments, for example, the structure for slidingly connecting the upper receiver 112 to the lower receiver 114 may include a single rail or groove on one of the upper or lower receiver 112, 114 with a complementary groove or rail on the other of the upper or lower receiver 112, 114. In other particular embodiments, the structure for slidingly connecting the upper receiver 112 to the lower receiver 114 may include multiple rails or grooves on one of the upper or lower receiver 112, 114 with complementary grooves or rails on the other of the upper or lower receiver 112, 114. If multiple rails or grooves are present on the upper and lower receivers 112, 114, the multiple rails or grooves may be spaced axially, radially, or circumferentially on the respective upper and lower receivers 112, 114.

Figure 4:
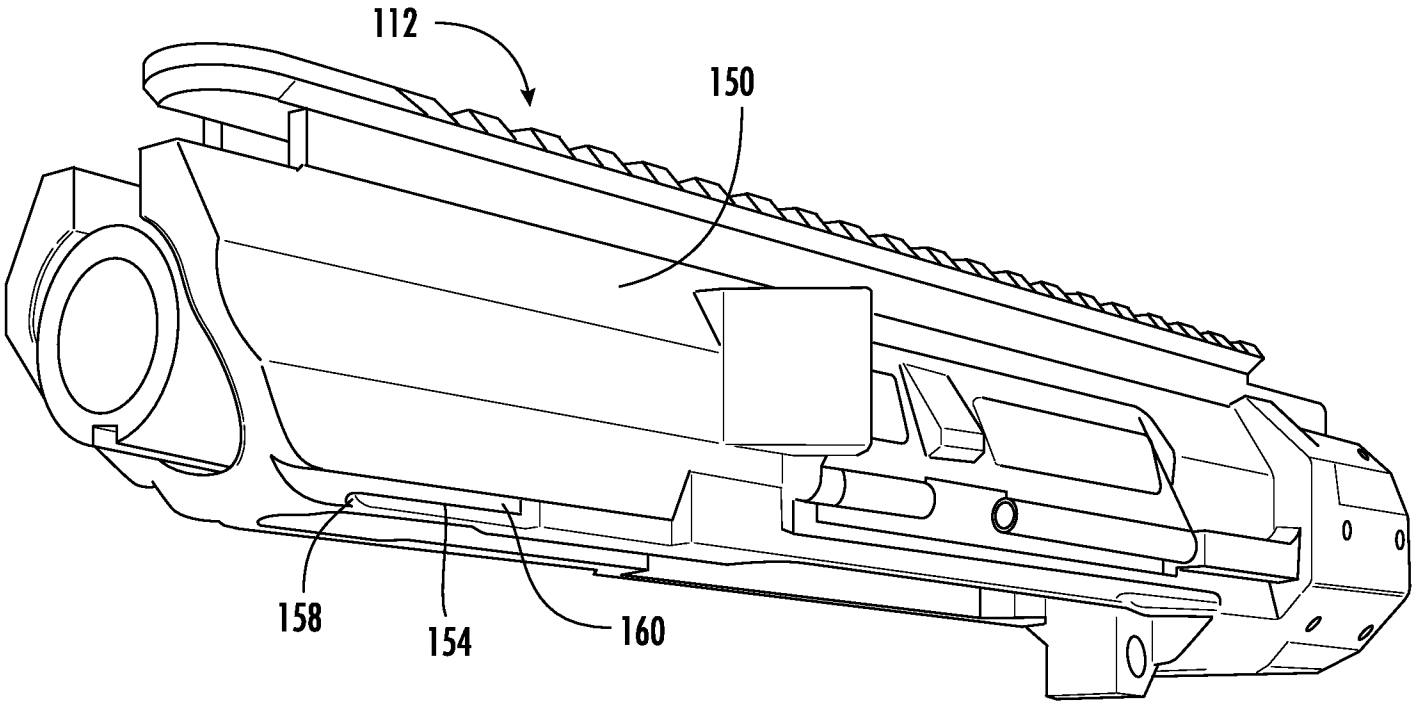
FIG. 4 is a right, rear perspective view of the upper receiver shown in FIGS. 2 and 3.
Figure 5:
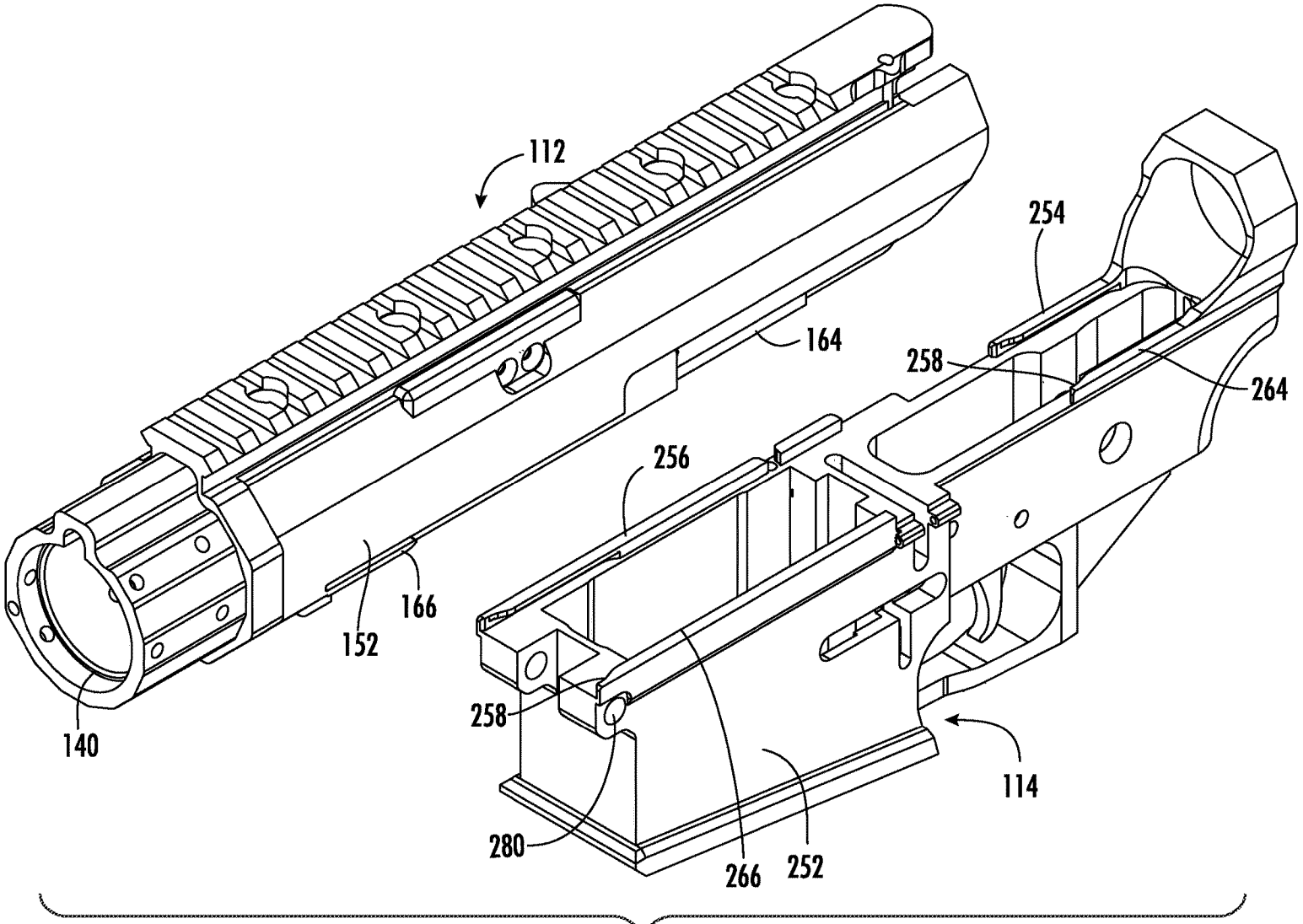
FIG. 5 is a left, front exploded perspective view of the upper and lower receivers shown in FIGS. 2 and 3.

FIG. 4 provides a right, rear perspective view of the upper receiver 112 shown in FIGS. 2 and 3, and FIG. 5 provides a left, front exploded perspective view of the upper and lower receivers 112, 114 shown in FIGS. 2 and 3. As shown in FIGS. 4 and 5, the upper receiver 112 includes a first side 150 and a second side 152. The first and second sides 150, 152 of the upper receiver 112 are opposed to one another and extend axially along the upper receiver 112. As shown most clearly in FIG. 4, the first side 150 of the upper receiver 112 includes a rear rail 154 and a front rail 156 that extend axially along a portion of the first side 150 of the upper receiver 112. The rear-most portion of each rail 154, 156 may include a tapered end 158. The rear and front rails 154, 156 define a rear groove 160 and a front groove 162, respectively, on the first side 150 of the upper receiver 112 that extend axially along a portion of the first side 150 of the upper receiver 112. The second side 152 of the upper receiver 112 similarly includes rear and front rails 164, 166 that define rear and front grooves 170, 172, respectively, on the second side 152 of the upper receiver 112 that extend axially along a portion of the second side 152 of the upper receiver 112. In this manner, the pair of rear rails 154, 164 define a pair of rear grooves 160, 170 that are axially separated from the pair of front grooves 162, 172 defined by the pair of front rails 156, 166.

As shown in FIGS. 3 and 5, the lower receiver 114 includes a first side 250 and a second side 252. The first and second sides 250, 252 of the lower receiver 114 are opposed to one another and extend axially along the lower receiver 114. As shown most clearly in FIG. 5, the second side 252 of the lower receiver 114 includes a rear rail 264 and a front rail 266 that extend axially along a portion of the second side 252 of the lower receiver 114. The front-most portion of each rail 264, 266 may include a tapered end 258. The rear and front rails 264, 266 define a rear groove 270 and a front groove 272, respectively, on the second side 252 of the lower receiver 114 that extend axially along a portion of the second side 252 of the lower receiver 114. The first side 250 of the lower receiver 114 similarly includes rear and front rails 254, 256 that define rear and front grooves 260, 262, respectively, on the first side 250 of the lower receiver 114 that extend axially along a portion of the first side 250 of the lower receiver 114. In this manner, the pair of rear rails 254, 264 define a pair of rear grooves 260, 270 that are axially separated from the pair of front grooves 262, 272 defined by the pair of front rails 256, 266.

Figure 6:
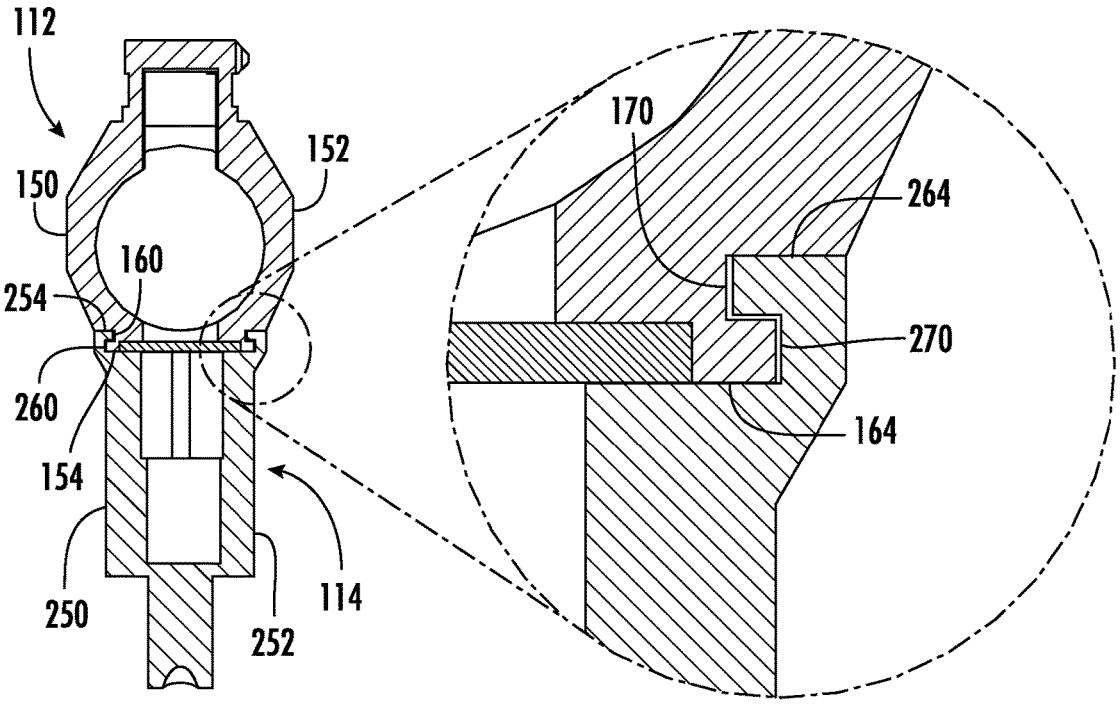
FIG. 6 is an axial plan view of the upper and lower receivers shown in FIG. 3, taken along line 6-6.
Figure 7:
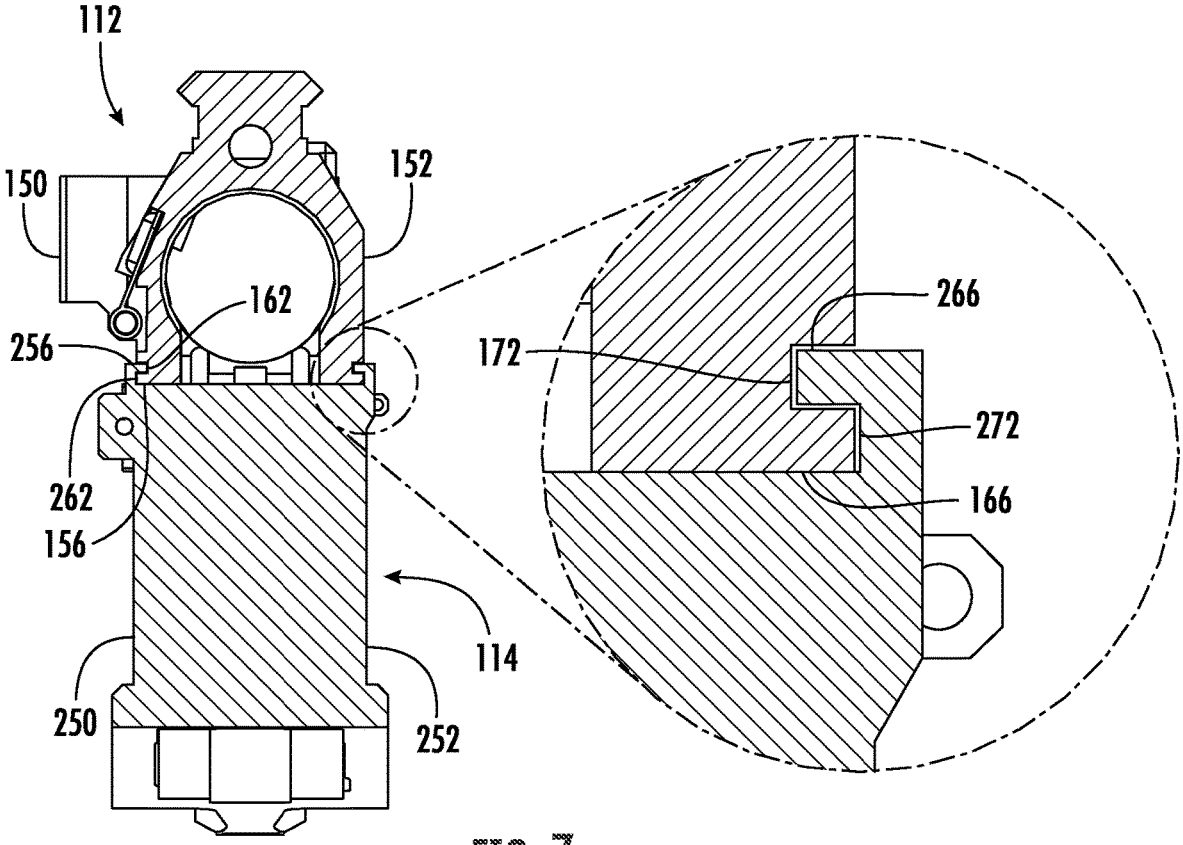
FIG. 7 is an axial plan view of the upper and lower receivers shown in FIG. 3, taken along line 7-7.

FIG. 6 provides an axial plan view of the upper and lower receivers 112, 114 shown in FIG. 3, taken along line 6-6, and FIG. 7 provides an axial plan view of the upper and lower receiver 112, 114 shown in FIG. 3, taken along line 7-7. As shown in FIG. 6, the pair of rear rails 154, 164 and the pair of rear grooves 160, 170 on the upper receiver 112 are engaged with the complementary pair of rear rails 254, 264 and rear grooves 260, 270 on the lower receiver 114. Similarly, as shown in FIG. 7, the pair of front rails 156, 166 and the pair of front grooves 162, 172 on the upper receiver 112 are engaged with the complementary pair of front rails 256, 266 and front grooves 262, 272 on the lower receiver 114.

Figure 8:
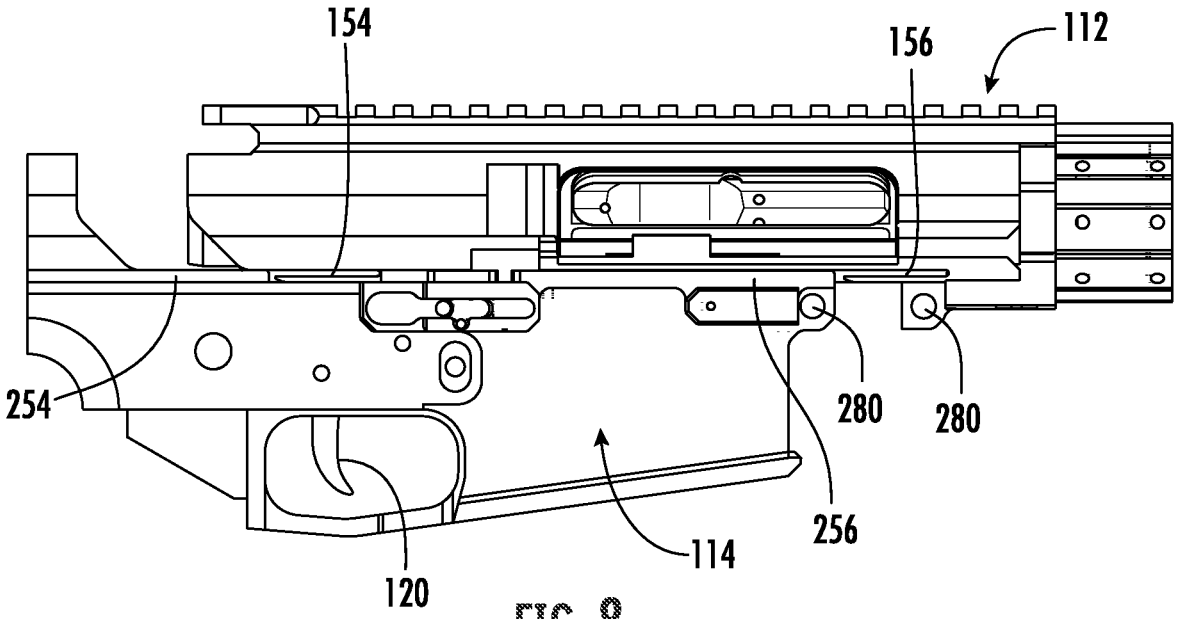
FIG. 8 is a right plan view of the upper and lower receivers shown in FIG. 2 being assembled.
Figure 9:
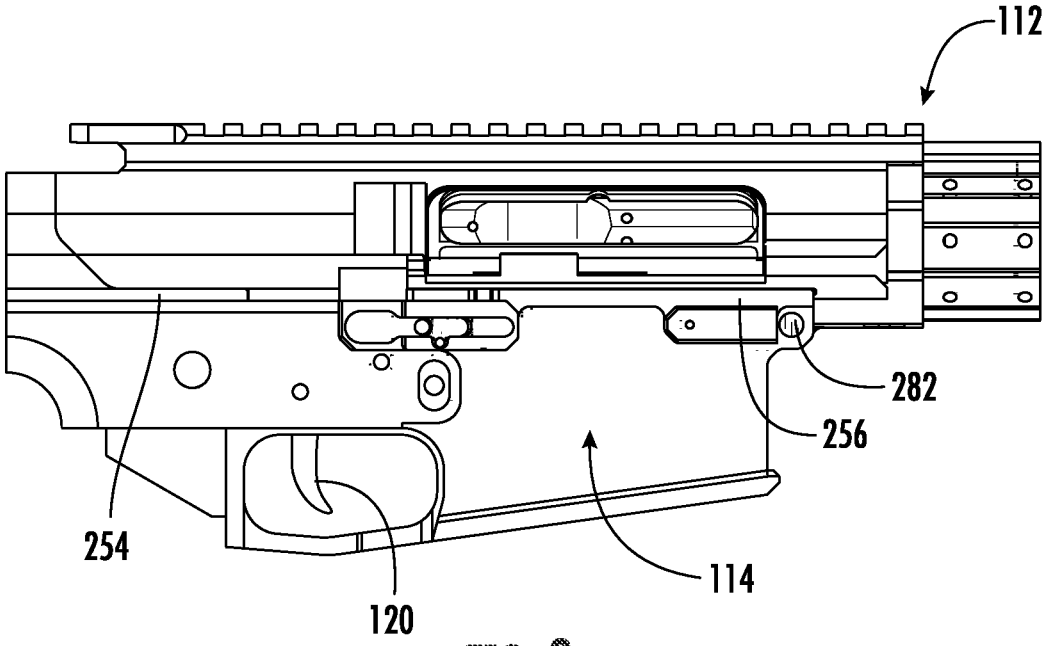
FIG. 9 is a right plan view of the upper and lower receivers shown in FIG. 2 assembled.

FIG. 8 provides a right plan view of the upper and lower receivers shown in FIG. 2 being assembled, and FIG. 9 provides a right plan view of the upper and lower receivers shown in FIG. 2 assembled. As shown in FIG. 8, the upper receiver 112 is first positioned forward of and against the lower receiver 114. The upper receiver 112 and lower receiver 114 are then slid toward each other, and the tapered ends 158 of the rear-most portion of the rear rails 154, 164 and front rails 156, 166 on the upper receiver 112 and the tapered ends 258 of the front-most portion of the rear rails 254, 264 and front rails 256, 266 on the lower receiver 114 guide the sliding engagement between the respective rails and grooves until the upper receiver 112 is fully slidingly engaged with or connected to the lower receiver 114, as shown in FIG. 9. As shown in FIGS. 8 and 9, the upper and lower receivers 112, 114 may each include a through bore 280, and a pin 282 may be inserted through the through bores 280 to lock the upper and lower receivers 112, 114 in sliding engagement. In particular embodiments, the pin 282 may be constructed from steel or titanium to reduce wear and erosion during use.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A firearm, comprising:

a barrel having a breech end;

an upper receiver engaged with the breech end of the barrel such that a majority of the barrel is outside of the upper receiver;

a lower receiver releasably connected to the upper receiver; and means for slidingly connecting the upper receiver to the lower receiver.

2. The firearm as in claim 1, wherein the means for slidingly connecting the upper receiver to the lower receiver comprises a first pair of grooves that extend axially along the upper receiver, a first pair of rails that extend axially along the lower receiver, and the first pair of grooves slidingly connect to the first pair of rails.

3. The firearm as in claim 1, wherein the means for slidingly connecting the upper receiver to the lower receiver comprises a first pair of grooves that extend axially along the upper receiver, a second pair of grooves that extend axially along the upper receiver, and the first pair of grooves are axially separated from the second pair of grooves.

4. The firearm as in claim 1, wherein the means for slidingly connecting the upper receiver to the lower receiver comprises a first pair of grooves that extend axially along the lower receiver, a second pair of grooves that extend axially along the lower receiver, and the first pair of grooves are axially separated from the second pair of grooves.

5. The firearm as in claim 1, wherein the means for slidingly connecting the upper receiver to the lower receiver comprises a rail that extends axially along the upper receiver, and the rail has a tapered end.

6. The firearm as in claim 1, wherein the means for slidingly connecting the upper receiver to the lower receiver comprises a rail that extends axially along the lower receiver, and the rail has a tapered end.

7. The firearm as in claim 1, further comprising a pin that extends through at least a portion of the upper and lower receivers when the upper and lower receivers are slidingly connected.

8. The firearm as in claim 1, further comprising a gas tube that provides fluid communication from downstream of the breech end of the barrel to the upper receiver.

9. A firearm, comprising:

a barrel having a breech end;

an upper receiver engaged with the breech end of the barrel such that a majority of the barrel is outside of the upper receiver;

a first side of the upper receiver;

a second side of the upper receiver opposed to the first side of the upper receiver;

a first groove that extends axially along the first side of the upper receiver;

a second groove that extends axially along the second side of the upper receiver; and a lower receiver slidingly connected to the first and second grooves of the upper receiver.

10. The firearm as in claim 9, further comprising a third groove that extends axially along the first side of the upper receiver and is axially separated from the first groove and a fourth groove that extends axially along the second side of the upper receiver and is axially separated from the second groove.

11. The firearm as in claim 9, further comprising a rail that extends axially along the upper receiver, and the rail has a tapered end.

12. The firearm as in claim 9, further comprising a rail that extends axially along the lower receiver, and the rail has a tapered end.

13. The firearm as in claim 9, further comprising a pin that extends through at least a portion of the upper and lower receivers when the upper and lower receivers are slidingly connected.

14. The firearm as in claim 9, further comprising a gas tube that provides fluid communication from downstream of the breach end of the barrel to the upper receiver.

15. A firearm, comprising:

a barrel having a breech end;

an upper receiver engaged with the breech end of the barrel such that a majority of the barrel is outside of the upper receiver;

a lower receiver releasably connected to the upper receiver;

a first side of the lower receiver;

a second side of the lower receiver opposed to the first side of the lower receiver;

a first groove that extends axially along the first side of the lower receiver;

a second groove that extends axially along the second side of the lower receiver; and the first and second grooves slidingly engage with the upper receiver.

16. The firearm as in claim 15, further comprising a third groove that extends axially along the first side of the lower receiver and is axially separated from the first groove, a fourth groove that extends axially along the second side of the lower receiver and is axially separated from the second groove, and the third and fourth grooves slidingly engage with the upper receiver.

17. The firearm as in claim 15, further comprising a rail that extends axially along the upper receiver, and the rail has a tapered end.

18. The firearm as in claim 15, further comprising a rail that extends axially along the lower receiver, and the rail has a tapered end.

19. The firearm as in claim 15, further comprising a pin that extends through at least a portion of the upper and lower receivers when the upper and lower receivers are slidingly engaged.

20. The firearm as in claim 15, further comprising a gas tube that provides fluid communication from downstream of the breach end of the barrel to the upper receiver.

* * * * *